United States Patent [19]

Ray et al.

[11] Patent Number: 4,910,720

[45] Date of Patent: Mar. 20, 1990

[54] WATCH HAVING A VISIBLE ENERGY PRODUCING OSCILLATORY MASS

[75] Inventors: Claude Ray, Montezillon; Michiel Groothuis, Saint-Imier, both of Switzerland

[73] Assignee: Le Phare-Jean D'Eve S.A., Switzerland

[21] Appl. No.: 321,281

[22] Filed: Mar. 9, 1989

[30] Foreign Application Priority Data

Mar. 21, 1988 [CH] Switzerland ..... 1.061/88

[51] Int. Cl.[4] ..... G04B 5/02

[52] U.S. Cl. ..... 368/148; 368/204; 368/150

[58] Field of Search ..... 368/204, 149, 150

[56] References Cited

U.S. PATENT DOCUMENTS 4,008,566 2/1977 McClintock ..... 368/204
4,644,246 2/1987 Knapen ..... 368/204

FOREIGN PATENT DOCUMENTS 2751797 5/1979 Fed. Rep. of Germany ..... 368/150
312036 12/1955 Switzerland ..... 368/208

*Primary Examiner*—Bernard Roskoski
*Attorney, Agent, or Firm*—Silverman, Cass & Singer, Ltd.

[57] ABSTRACT

An oscillatory mass operative to drive the rotor of a current generator adapted to charge a capacitor feeding the clockwork of an electronic watch is situated above the dial of the watch, which dial serves as a supporting plate for this mass. The arm of the mass is articulated at the center of the clockwork by means of a ball-bearing carried by the plate constituting the dial. The hours division is of relatively small diameter, leaving free the annular part of the dial opposite which the peripheral portion of the mass moves. The dial serves at the same time as a supporting member for the outer journal ring of a ball-bearing supporting the oscillatory mass and is secured to the frame of the clockwork by means of screws. The outer journal ring of the ball-bearing supporting the mass is rigid with a pinion meshing with a pinion of gearing coupled to the rotor of an electric generator driven by the said mass.

8 Claims, 2 Drawing Sheets

WATCH HAVING A VISIBLE ENERGY PRODUCING OSCILLATORY MASS

BACKGROUND OF THE INVENTION (a) Field of the Invention

This invention relates to a watch comprising an oscillatory mass which produces the energy which is necessary for the running of the clockwork of the watch and which is rotatably mounted in the center of the clockwork.

(b) Description of the Prior Art

Such watches are known per se. The oscillatory rotative mass is employed, most generally, for winding a main spring or in the case of an electronic watch, can be used to drive the rotor of a current generator adapted to charge an accumulator or a capacitor furnishing the power producing the running of the clockwork.

In the known watches having an oscillatory rotatable mass, this rotatable mass is situated, most generally, at the periphery of the clockwork, an arm which connects this peripheral part to the center of rotation passing under the clockwork, on the side of the bridges of a frame thereof, between the bottom of the watch casing an the clockwork.

SUMMARY OF THE INVENTION

The object of the present invention is to furnish a novel construction of such a watch, more particularly of the mounting of the oscillatory rotatable mass of this watch, which is at the same time less cumbersome and robust and which, moreover, permits an easy connection between the mass and the gearing coupled to the element which it must drive.

To this end, a watch according to the invention has a part of the oscillatory mass connecting a peripheral portion of the said mass and its center of rotation passing above the dial of the watch.

The various features o the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 3:
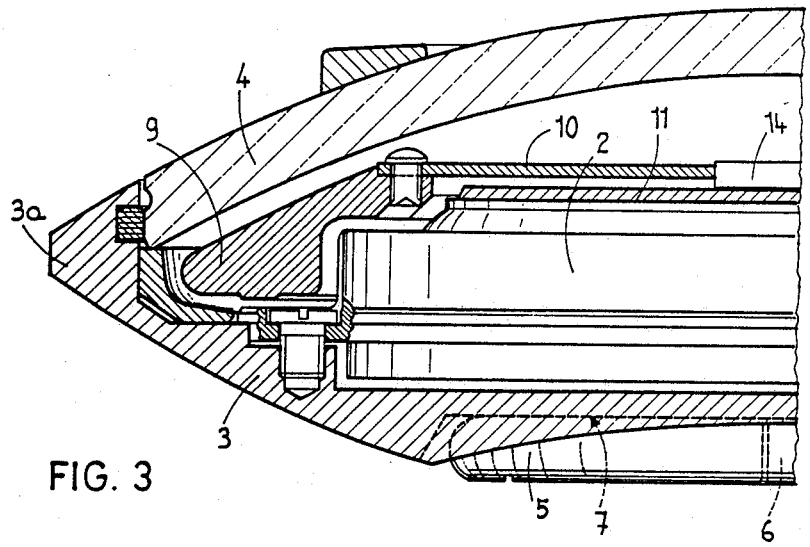
FIG. 3 is a sectional view of a peripheral portion of the clockwork of the watch of FIG. 1, also to a larger scale.

The wrist-watch illustrated, generally designated by reference 1, comprises clockwork 2 located in a waterproof casing comprising a back and a middle-part 3 made of one piece and a glass 4 engaged in the peripheral portion 3*a* of the back/middle-part, constituting the body of the casing, Since this embodiment is an electronic watch, it does not have any winding member, but comprises a setting element constituted by a ring 5, visible in FIG. 3, articulated on a member 6 and which is used for turning this member 6; this ring 5 can occupy either the position shown, in which it is turned down into a recess 7 of the back/middle-part, or an operative position in which it is lifted out from the recess 7.

Figure 4:
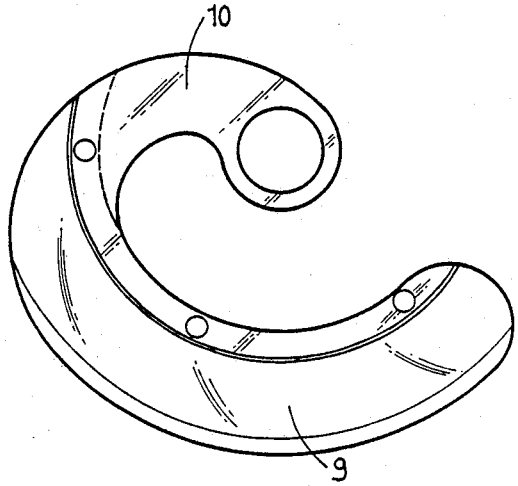
FIG. 4 is a plan view of a detail of this watch, also to a larger scale.

This watch comprises a current generator intended to charge an electric capacitor feeding the clockwork. The rotor of this generator, designated by reference 8 (FIG. 2), is operated by an oscillatory mass rotatably mounted at the center of the clockwork and illustrated in detail in FIG. 4, which comprises a massive peripheral portion: 9, having the shape of a segment of a crown, and an arm 10 connecting this peripheral portion 9 to the center of oscillation of the said mass. The peripheral portion 9 is situated, as shown by FIG. 3, between the periphery of the clockwork 2 and the peripheral portion 3*a* of the back/middle-part 3. So far as the arm 10 is concerned, which has the shape of an arc of circle, it is arranged in such a way as to appear as a continuing prolongation of the peripheral portion 9. This arm is situated above the dial of the watch, designated by reference 11.

Figure 1:
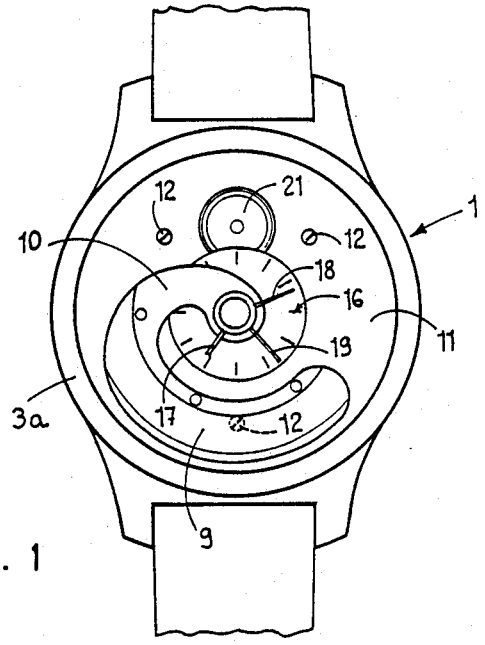
FIG. 1 is a plan view of a wrist-watch in accordance with the invention.

The dial 11 is relatively thick and is used as a plate supporting the oscillatory mass; it is secured to the frame of the clockwork 2 by means of three screws 12 visible in FIG. 1. This plate 11 is provided with a central part 11*a* which is recessed with respect to its general plane (FIG. 2) and which is provided, at is center, with a collar 11*b* on which is pressed the inner journal ring, designated by reference 13, of a ball-bearing the outer journal ring of which, designated by reference 14, carries, press-fitted thereon, the connecting arm 10 of the oscillatory mass. It is to be noted that this outer journal ring 14 of the ball-bearing is provided with teeth 14*a* so as to constitute a pinion which, in this manner, is rigid with the oscillatory mass and which constitutes the first element of gearing coupled to the rotor 8 of the current generator.

Figure 2:
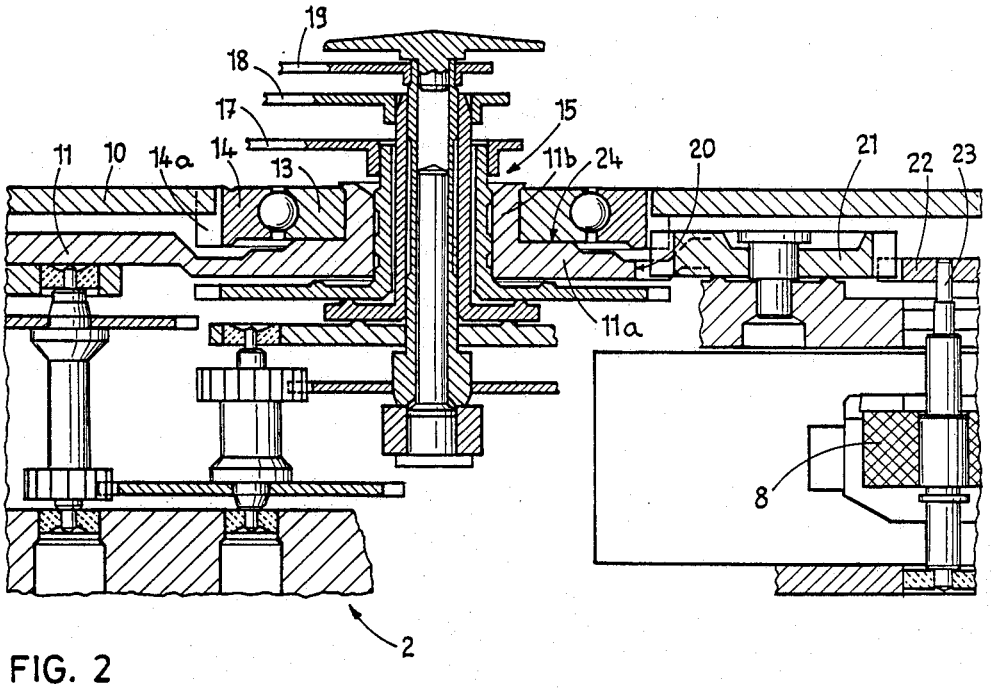
FIG. 2 is a sectional view of this watch, passing through the center of the watch, to a larger scale.

The central collar 11*b* of the plate 11 constituting the dial and which supports the oscillatory mass is traversed by the cannons which support the hands of the watch, generally designated by reference 15 (FIG. 2). The hours division, designated by reference 16 in FIG. 1, is not situated at the periphery of the dial, but at the center thereof, the hands indicating the date, the hour hand and the minute hand, designated by references 17, 18 and 19, respectively, being dimensioned, in length, so as to correspond to this central dial division. This way, the peripheral portion of the dial, swept by the part 9 of the mass, is free of any date/time indication.

The plate 11 supporting the oscillatory rotatable mass is provided with a hole 20 (FIG. 2) in which is located a pinion 21 meshing with a pinion 22 mounted on a shaft, designated by reference 23, of the rotor 8 of the generator. This pinion 21 itself meshes with the teeth 14*a* of the outer journal ring 14 of the ball-bearing supporting the oscillatory mass. As shown by FIG. 2, the meshing of the pinion 21 with the teeth 14*a* is effected only over a part of their height, the ball-bearing being located in a recess 24 provided, on the outer face of the plate 11, by its central portion 11*a* which is recessed; the pinion 21 is located substantially within the thickness of the plate 11.

It is to be noted that pinion 21 is visible as shown by FIG. 1, as well as the central ball-bearing supporting the oscillatory mass.

The various elements of the gearing, some of which are visible in FIG. 2, will not be disclosed here, being known per se.

We claim:

1. A watch comprising clockwork and an oscillatory mass operative to produce the energy necessary for the running of the clockwork and rotatably mounted at the centre of the clockwork, in which a part of said oscillating mass connecting a peripheral portion of said mass and its center of oscillation passes above a dial of the watch.

2. A watch as claimed in claim 1, in which the peripheral portion of the oscillatory mass, having the shape of a segment of a crown, is situated at the periphery of the clockwork, between the latter and a body of a casing of the watch, said part of the mass which connects the peripheral portion thereof and its center of oscillation being constituted by an arcuate arm arranged in such a way as to appear as being a continuing prolongation of said peripheral portion.

3. A watch as claimed in claim 1, in which the oscillatory mass is supported by a plate covering the clockwork and which constitutes the dial of the watch.

4. A watch as claimed in claim 3, in which said plate supporting the oscillatory mass is secured by screws to a frame of the clockwork.

5. A watch as claimed in claim 3, in which said plate is provided, at its center, with a collar on which is mounted an inner journal ring of a ball-bearing the outer journal ring of which is rigid with said part of the oscillatory mass which connects the peripheral portion of this mass to its center of rotation.

6. A watch as claimed in claim 5, in which the outer journal ring of the ball-bearing supporting the oscillatory mass is rigid with a pinion which, in this manner, is rigid with said mass, said pinion constituting the first element of gearing coupled to an element of the clockwork which has to be driven by said mass.

7. A watch as claimed in claim 6, in which said pinion rigid with the oscillatory mass meshes with a second pinion a shaft of which passes through an aperture provided in the plate supporting said mass.

8. A watch as claimed in claim 7, in which said plate supporting the oscillatory mass is provided with a recessed central portion, said pinion with which meshes the pinion rigid with the oscillatory mass being situated in said aperture of said plate, substantially within the thickness of this plate, while the pinion rigid with the mass is partially located, in height, in the central recess of the plate.

* * * * *